US006461280B1

(12) United States Patent
Benedikter

(10) Patent No.: US 6,461,280 B1
(45) Date of Patent: Oct. 8, 2002

(54) TRAINING APPARATUS

(75) Inventor: Franz Benedikter, Rome (IT)

(73) Assignee: Technoworld GmbH, Schönbuch (DE)

( * ) Notice: Subject to any disclaimer, the term of this patent is extended or adjusted under 35 U.S.C. 154(b) by 0 days.

(21) Appl. No.: 09/446,130

(22) PCT Filed: Jun. 26, 1998

(86) PCT No.: PCT/EP98/03906

§ 371 (c)(1),
(2), (4) Date: Jan. 21, 2000

(87) PCT Pub. No.: WO99/01184

PCT Pub. Date: Jan. 14, 1999

(30) Foreign Application Priority Data

Jun. 30, 1997 (DE) ..... 197 27 812

(51) Int. Cl.[7] ..... A63B 71/00
(52) U.S. Cl. ..... 482/74; 482/70; 482/62
(58) Field of Search ..... 482/70, 51, 52, 482/57, 147, 148, 62, 907

(56) References Cited

U.S. PATENT DOCUMENTS 4,709,918 A 12/1987 Grinblat
4,948,124 A 8/1990 Ghaly
5,368,533 A 11/1994 Feuer et al.
5,411,454 A * 5/1995 Chang ..... 482/53
5,632,711 A 5/1997 Hwang
5,408,373 A * 6/1999 Pitre ..... 482/57
5,924,961 A * 7/1999 Kuo et al. ..... 482/52
6,179,752 B1 * 1/2000 Chang ..... 482/52
6,132,341 A * 10/2000 Lin ..... 482/52

* cited by examiner

*Primary Examiner*—Jerome W. Donnelly
(74) *Attorney, Agent, or Firm*—Greenblum & Bernstein, P.L.C.

(57) ABSTRACT

Training apparatus that includes a base unit and foot plates moveably arranged on the base unit for movement in opposite directions and in an essentially same plane. The foot plates are adapted to accommodate the feet of a user. A support unit, which is adapted to support at least one of upper extremities or a head region of the user, is rotatable around an axis essentially perpendicular to the same plane. A transmission mechanism is coupled to the foot plates and the support unit so that movement of the foot plates is transformed into rotational movement of the support unit around the axis.

29 Claims, 3 Drawing Sheets

TRAINING APPARATUS

CROSS-REFERENCE TO RELATED APPLICATIONS

The present application is a U.S. National Stage Application of International Application No. PCT/EP98/03906 filed Jun. 26, 1998 and claims priority under 35 U.S.C. § 119 of German Patent Application No. 197 27 812.4 filed Jun. 30, 1997.

BACKGROUND OF THE INVENTION

1. Field of the Invention

The present invention concerns a training apparatus with a base unit, with foot plates moveably arranged on this base unit to accommodate the feet of a user, and with a support unit for the upper extremities or head region of the user.

2. Discussion of Background Information

Training apparatuses of various types are known for personal endurance or strength training. Training apparatuses designed for leg training include foot plates which accommodate the feet of the user. With the aid of the movable foot plates, the user can simulate a running or climbing motion. The user typically holds onto a support unit, such as two stationarily arranged grips.

Known training apparatuses of the abovementioned type are designed solely for the movement of a specific body part, in order to exercise the muscles of that body part. Thus, only the athletic aspect, namely muscle training of the user, is emphasized. However, known training apparatuses fail to consider those mechanisms of the human body that form a link between the mind and the body.

SUMMARY OF THE INVENTION

The present invention provides a training apparatus of the aforementioned type which, by a targeted induced movement of the user, also promotes the endogenous production of endorphins and evens out the normally uneven distribution of energy and hormones within the body.

Accordingly, the training apparatus of the instant invention includes foot plates connected to the support unit by a transmission mechanism, such that movement of the foot plates in opposite directions, and essentially within a same plane is forcibly transformed into a rotational movement of the support unit about an axis which runs at essentially right angles to this plane.

Here, it is preferred for a contact element, securely fixed to the apparatus, to be arranged between the foot plate and support unit and vertically positionably adjustable into a position that substantially corresponds to the position of the user's solar plexus.

A particularly good effect is obtained in that the transformation of movement occurs in such a manner that, the upper half of the user's body can be rotated in a direction opposite a rotational direction of the lower half of the user's body.

The training apparatus according to the invention takes advantage of the knowledge that specific, trainable movements of the body affect not only the physical, but also the mental well-being of the user in a positive manner, because the endogenous release of endorphins is facilitated and a more parasympathetically emphasized hormonal pattern is induced which is associated with lowering of the blood pressure and other processes which promote holistic relaxation.

The training apparatus according to the invention thus fundamentally departs from known training apparatuses which are designed under the concept of physical fitness, as they are traditionally used in fitness clubs and the like.

In preferred embodiment of the invention, the contact element is adjustable in height and is preferably heatable.

These measures have the advantage that first, the apparatus may be adapted to different body sizes, and second, enhanced well-being of the user may be achieved by heating the contact element.

In additional embodiments of the apparatus according to the invention, the support unit is adjustable in height.

This measure has the advantage that the apparatus according to the invention is adjustable for various body positions. For example, the support unit can be arranged at the user's chest height such that the user can support himself with the hands at chest height against the support unit. If, on the other hand, the support unit is arranged at shoulder height, the user can support himself with the forearms and/or the upper arms and/or the shoulder and/or the neck and/or the head against the support unit. Finally, the support unit can be arranged above the head of the user such that with upwardly extended arms the user can grip the support unit with his hands.

In order to enable use of the training apparatus in these various positions, the support unit can be provided with differently arranged and aligned grips and supports which run either at right angles to the rotational axis or parallel to the same.

In order to create the rotational movement of the support unit from the movement of the foot plates in opposite directions, it is preferred for the foot plates to be respectively connected to a segment of a common belt such that the belt runs over pulleys and at least one of the pulleys is connected to the rod such that it can be driven.

This measure has the advantage that the aforementioned transmission mechanism can be produced in a particularly simple and cost-effective manner.

Although the training apparatus according to the invention can be used in different configurations, it is preferred for the axis to run essentially vertically, i.e., with the user in an essentially standing position.

The present invention is directed to a training apparatus that includes a base unit and foot plates moveably arranged on the base unit for movement in opposite directions and in an essentially same plane. The foot plates are adapted to accommodate the feet of a user. A support unit, which is adapted to support at least one of upper extremities or a head region of the user, is rotatable around an axis essentially perpendicular to the same plane. A transmission mechanism is coupled to the foot plates and the support unit so that movement of the foot plates is transformed into rotational movement of the support unit around the axis.

In accordance with a feature of the present invention, a contact element can be securely fixed between the base unit and the support unit. The contact element may be vertically positionably adjustable to a desired height. Further, the desired height can be adapted to correspond to a user's solar plexus. Moreover, the contact element may be heatable.

According to another feature of the instant invention, the transmission mechanism can be coupled to the foot plates and support element such that the support element is adapted to rotate in a direction toward a foot plate which is moving toward the support element. In this manner, the apparatus can be adapted such that rotation of a lower half of the user's body in one direction results in a rotation of an upper half of the user's body in an opposite direction.

According to still another feature of the invention, the support unit can be vertically positionably adjustable.

Further, the support unit includes at least two grips which are adapted to be grasped by the user's hands. The at least two grips can be oriented essentially perpendicular to the axis. Further, the at least two grips can be oriented essentially parallel to the axis. Moreover, the at least two grips can include at least four grips, and at least two grips can be oriented essentially parallel to the axis, and at least two grips can be oriented essentially perpendicular to the axis. Still further, the support unit may include a support adapted to support at least one of the shoulder, neck, and head of the user. The at least two grips and the support may be arranged on a common, closed bar linkage.

In accordance with a further feature of the present invention, the support unit may include a support adapted to support at least one of the shoulder, neck, and head of the user.

In accordance with a still further feature of the instant invention, a rotatable rod can have a first and second end. The first end may be coupled to the support unit and the second end may be coupled to the base unit. Further, the rod can include a telescoping rod, whereby a distance between the support element and the base is adjustable. Moreover, the transmission mechanism can include pulleys, and the foot plates may be connected to each other with at least a segment of a common belt. The common belt can be guided over at least one of the pulleys, and the rod can be coupled to at least one of the at least one pulley and another of the pulleys.

According to another feature of the invention, the base unit can include rails. The foot plates may be coupled to and guided on the rails.

According to still another feature of the present invention, the axis can be essentially vertically oriented.

The present invention is also directed to a training apparatus that includes a base unit having rails and foot plates moveably arranged on the rails for movement in opposite directions and in an essentially same plane. The foot plates are adapted to accommodate the feet of a user. A support unit includes at least two hand grips and is adapted to support at least one of upper extremities or a head region of the user. The support unit vertically is positionably adjustable and rotatable around an axis essentially perpendicular to the same plane. A transmission mechanism is coupled to the foot plates and the support unit so that movement of the foot plates is transformed into rotational movement of the support unit around the axis, and a contact element is securely fixed between the base unit and the support unit. The contact element is vertically positionably adjustable to a desired height.

According to a feature of the instant invention, a telescoping rotatable rod can have a first and second end. The first end may be coupled to the support unit and the second end may be coupled to the base unit. A distance between the support element and the base can be adjustable. The transmission mechanism can be coupled to the foot plates and support element such that the support element is adapted to rotate in a direction toward a foot plate which is moving toward the support element.

In accordance with another feature of the instant invention, the at least two grips and are arranged on a common, closed bar linkage.

In accordance with yet another feature of the invention, the transmission mechanism can include pulleys and gears, the foot plates may be connected to a common belt, and the common belt may be guided over at least one of the pulleys. The at least one pulley can be coupled to one of the gears for rotatably driving the support element.

Additional advantages arise from the description and the accompanying drawings.

It is to be understood that the features described above and to be illustrated below are applicable not only in the combination respectively stated, but also in other combinations or alone, without departing from the scope of the present invention.

BRIEF DESCRIPTION OF THE DRAWINGS

Exemplary embodiments of the invention are shown in the drawings and are illustrated in more detail in the following description. Shown therein are the following.

DETAILED DESCRIPTION OF THE PRESENT INVENTION

Figure 1:
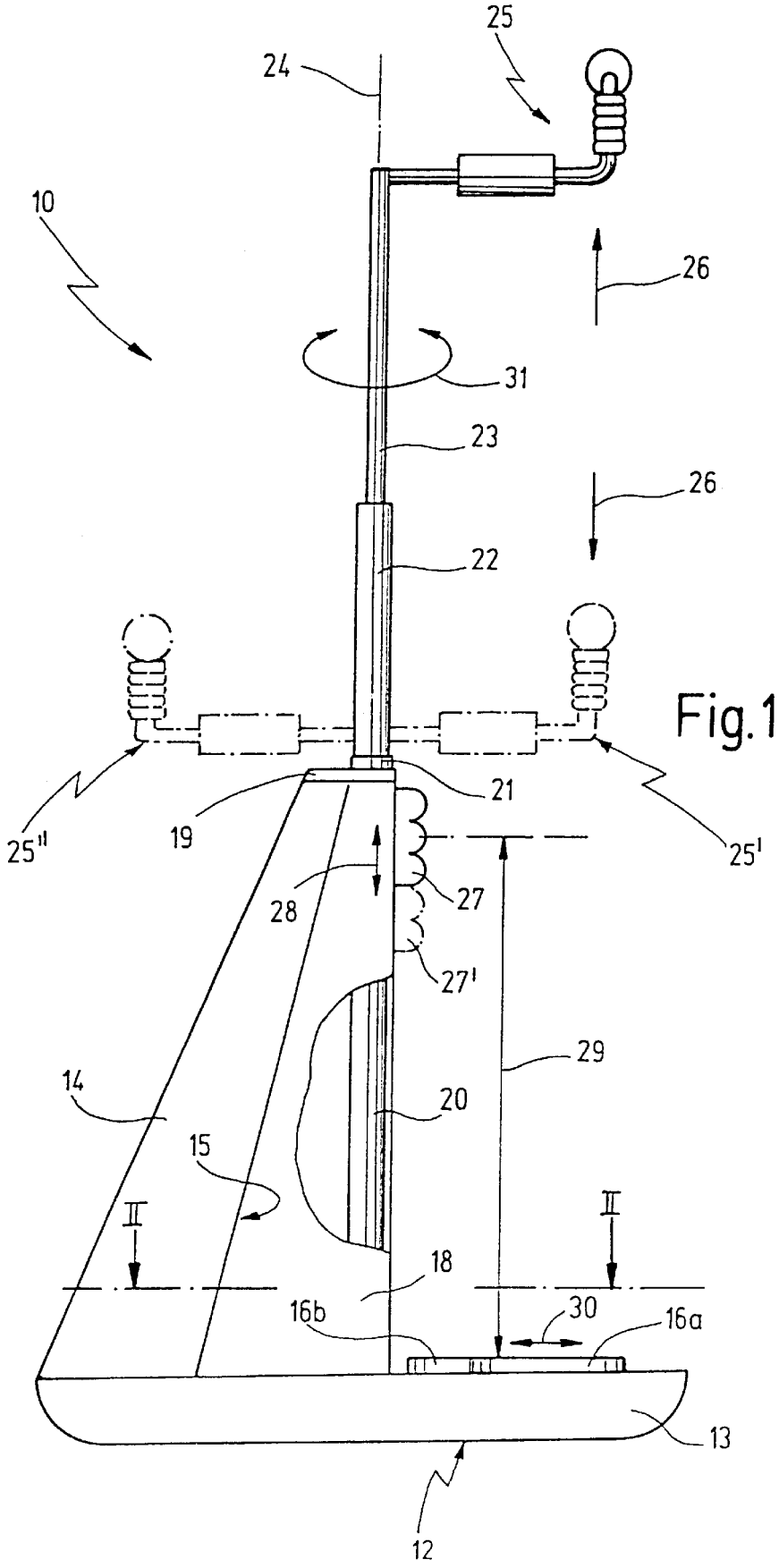
FIG. 1 A side view, partially cut away, of an exemplary embodiment of a training apparatus according to the invention.

An overall exemplary embodiment of a training apparatus according to the invention is depicted as 10 in FIG. 1.

The training apparatus 10 includes a base unit 12, which rests on a floor and which is enclosed by a housing 13. Further, base unit 12 transitions into a front covering 14, which is arranged to allow room on both sides of the base unit 12 for the feet or legs of the user (not shown).

Foot plates 16*a,* 16*b* are provided on the upper side of the base unit 12, and are shown (see, also, FIG. 2) as being displaced against one another in the longitudinal direction of the base unit 12.

Within the front covering 14 is centrally located a separation 18 which is located in the longitudinal axis of the base unit 12. The separation 18 and the front covering 14 terminate in a common upper cover 19.

Figure 2:
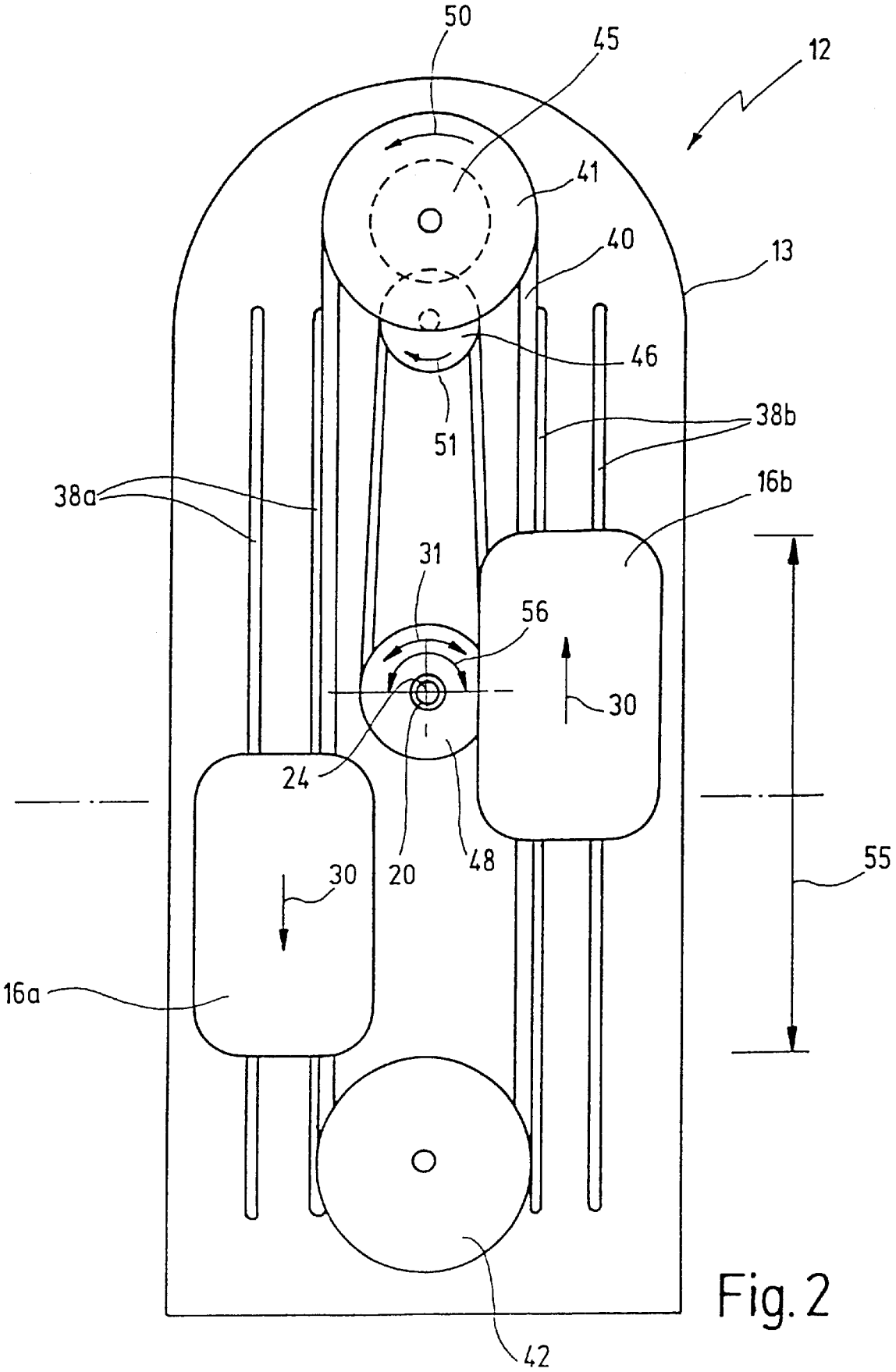
FIG. 2 A top view of the base unit of the training apparatus according to FIG. 1 in a view along the direction II—II of FIG. 1, enlarged.

The lower free end of a lower tube 20 is mounted in the base unit 12 (see, also, FIG. 2). The lower tube 20 is led through a pivot bearing 21 in the upper cover 19 and continues upward with an intermediate tube 22 and an upper tube 23. The tubes 20, 22, and 23 form a telescopic arrangement. The telescopic arrangement defines an axis 24, which in the illustrated exemplary embodiment runs vertically.

Figure 3:
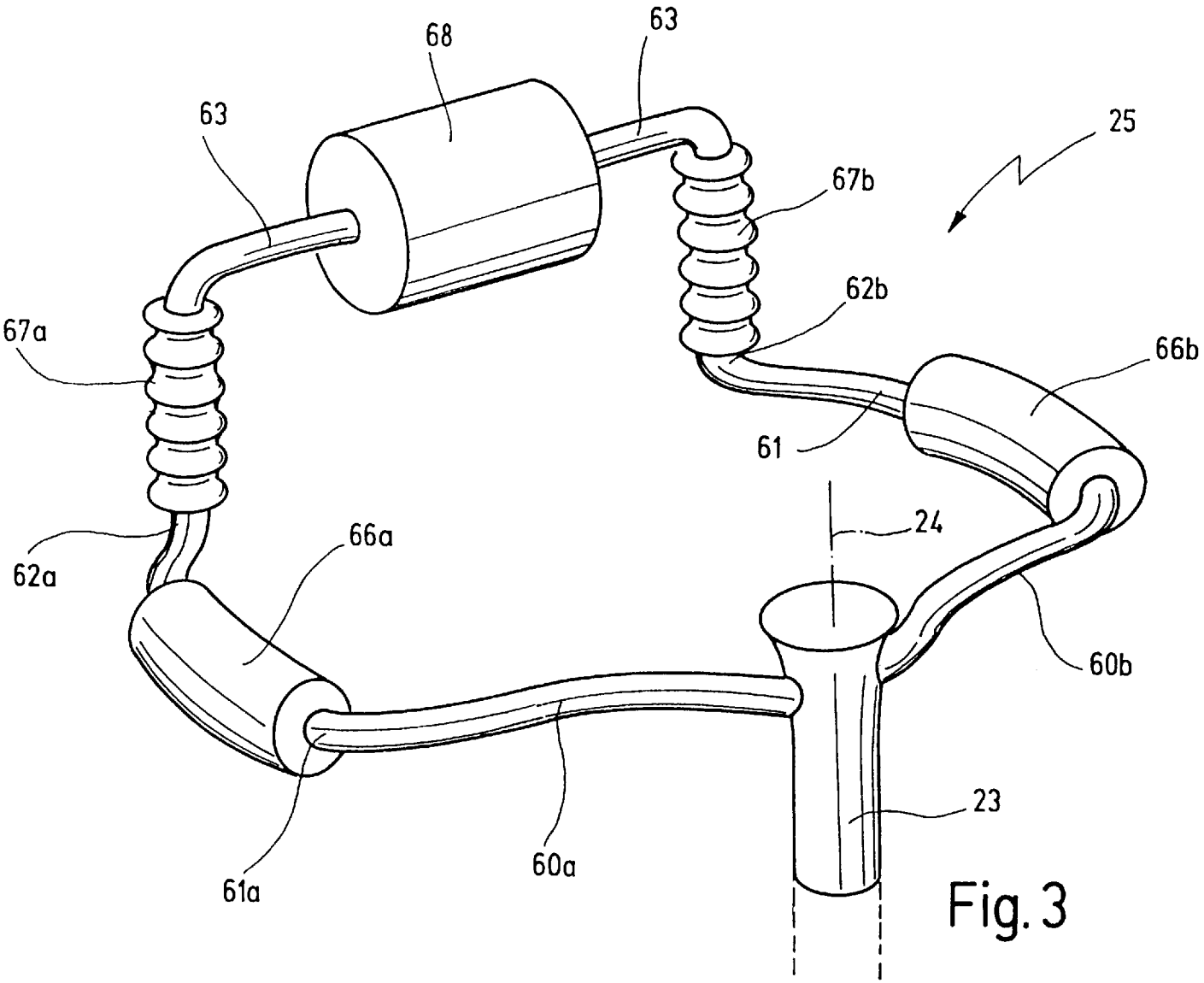
FIG. 3 A further enlargement of a perspective view of an exemplary embodiment of a support unit as it can be used with the training apparatus according to FIG. 1.

At the upper end of the upper tube 23 is arranged a support unit 25 (see, also, FIG. 3). The support unit 25 can be moved in a vertical direction on account of the telescopic nature of tubes 20, 22, and 23, as indicated by arrows 26. In FIG. 1 an upper end position of the support unit is indicated by 25, and a lower end position is indicated by 25'. In addition, 25" indicates that the support unit can also be rotated about the axis 24. It is important to note that in every operating position, the support unit 25 or 25' or 25" is rotationally rigidly connected to the lower tube 20 such that a rotational movement of the lower tube 20 is transformed into a corresponding rotational movement of the support unit 25, 25', or 25".

It may also be seen in FIG. 1 that a stationary contact element 27 is provided on the back side of the front covering 14. The contact element 27 is likewise adjustable in height, as indicated by an arrow 28. For example, it is shown by 27' that the contact element 27 can be pushed downward from the position denoted by solid lines.

The contact element 27 is positioned at a height 29 above the foot plates 16*a,* 16*b* which height is determined such that a user of the training apparatus 10 standing with the user's feet on the foot plates 16*a,* 16*b* can support himself on the stationary contact element 27 at the height of the user's solar plexus, i.e., slightly above the height of the user's stomach. The contact element 27 can also include fasteners, such as belts or the like.

In FIG. 1 an arrow 30 indicates that the foot plates 16*a,* 16*b* are slidable in opposite directions in a horizontal plane. This oppositely directional movement of the foot plates 16*a,* 16*b* is forcibly transformed into a rotational movement of the support unit 25, as indicated by an arrow 31.

In order to achieve this transformation of movement, a transmission mechanism whose particulars are depicted in FIG. 2 is provided in the base unit 12.

It can be seen that the foot plates 16*a,* 16*b* run on tracks 38*a,* 38*b*. In this manner, a linear, opposing movement of the foot plates 16*a,* 16*b* can be achieved, as indicated by arrows 30 in FIG. 2.

In order to synchronize this opposing movement and to simultaneously derive a rotational movement therefrom, the foot plates 16*a,* 16*b* are firmly connected to the opposing segments of a belt 40. The belt 40 runs over pulleys 41, 42 which are respectively located in the front and rear ends of the base unit 12. The belt can be a V-belt or toothed belt; it can also be substituted by a chain, cable, or other appropriate element.

The front pulley 41 is provided with a first toothed gear 45 which meshes with a second toothed gear 46. The second toothed gear 46 is simultaneously constructed as an additional pulley. This second toothed gear conducts a belt 47 which also runs over another pulley 48. The additional pulley 48 is rotationally rigidly connected to the lower tube 20. Other transmission mechanism configurations may also be used in this case.

The transmission mechanism shown in FIG. 2 operates as follows.

When the foot plates 16*a,* 16*b* are moved in opposite directions in the direction of the arrows 30 denoted in FIG. 2, the pulley 41 is caused to turn in the counterclockwise direction as indicated by an arrow 50. As a result, the second toothed gear 46 turns in the clockwise direction as indicated by an arrow 51. This rotation in turn creates the rotation of another pulley 48 and of the lower tube 20 to which the pulley is rotationally rigidly connected, as indicated by the arrow 31, also in FIG. 2.

In FIG. 2, a maximum stride length for the foot plates 16*a,* 16*b* is indicated by 55. The maximum stride length 55 can be approximately 60 cm.

Finally, the angle of rotation resulting from the maximum stride length 55 is indicated by 56, this angle preferably being approximately 180°.

In the transmission mechanism according to FIG. 2, it is important that during a forward movement of the right foot (footplate 16*b*) and a backward movement of the left foot (footplate 16*a*), the lower tube 20 and thus also the support unit 25 are rotated in the clockwise direction. While the lower half of the body rotates in the counterclockwise direction, the upper half of the body simultaneously rotates in the clockwise direction, i.e., in opposite directions. Between these two body halves, the center part of the body is stabilized in the direction of rotation by placing the solar plexus against the spatially fixed contact element 27 (FIG. 1).

Finally, FIG. 3 shows a preferred exemplary embodiment of the support unit 25.

As can be easily seen, projecting from the free end of the upper tube 23 on both sides are horizontal arms 60*a,* 60*b,* which then continue in the horizontal plane bent at a 90° angle. These arms transition at that point into second arms 61*a,* 61*b*. The second arms 61*a,* 61*b* then continue upwardly, bent into third arms 62*a,* 62*b* whose free ends are then finally connected to a horizontal, fourth arm 63 such that the arms 60 through 63 form overall a closed bar linkage.

On the second arms 61*a,* 61*b* are arranged first horizontal supports or grips 66*a,* 66*b*. The third arms 62*a,* 62*b,* in contrast, are provided with vertical grips 67*a,* 67*b*. Finally, the fourth arm 63 bears a second, horizontal support 68.

With the aid of the support unit 25 according to FIG. 3, the training apparatus 10 can be operated in various operating modes.

When the position of the support unit 25 depicted in FIG. 1 by solid lines is adjusted, the horizontal grips 66*a,* 66*b* are located far above the head of the user such that the user extends the arms upward and grasps the grips 66*a,* 66*b* with the hands. When the user now "walks" on the foot plates 16*a,* 16*b* and simultaneously presses firmly against the contact element 27 at the height of the user's solar plexus, the lower half of the user's body, namely that part below the rotationally rigidly held solar plexus, is respectively rotated in one direction during "walking," while the upper, upwardly stretched half of the body above the solar plexus is rotated in the respectively opposite direction at the same time with the aid of the transmission mechanism illustrated in FIG. 2.

When the support unit 25 is now moved to a lowered position as indicated by 25' in FIG. 1, the user can push upward with his upper body through the closed bar linkage according to FIG. 3 and support himself with the forearms or (according to the height adjustment) the upper arms on the supports 66*a,* 66*b*. Simultaneously, the user can support himself on the back side with the shoulder, neck, or head on the horizontal support 68.

When the support unit 25" is placed in a position swiveled forward by 180° in a third operating position, the user can extend his arms forward and grasp the vertical grips 67*a,* 67*b* with the hands.

In the latter two operating modes mentioned above, both halves of the user's body are also rotated opposite to one another in the manner previously described.

What is claimed is:

1. A training apparatus comprising:

a base unit;

foot plates moveably arranged on said base unit for movement in opposite directions and in an essentially same plane, wherein said foot plates are adapted to accommodate the feet of a user;

a support unit adapted to support at least one of upper extremities or a head region of the user, wherein said support unit is rotatable around an axis essentially perpendicular to said same plane; and a transmission mechanism coupled to said foot plates and said support unit so that movement of the foot plates is transformed into rotational movement of said support unit around the axis.

2. The training apparatus in accordance with claim 1, further comprising a contact element securely fixed between said base unit and said support unit.

3. The training apparatus in accordance with claim 2, wherein said contact element is vertically positionably adjustable to a desired height.

4. The training apparatus in accordance with claim 3, wherein the desired height is adapted to correspond to a user's solar plexus.

5. The training apparatus in accordance with claim 2, wherein said contact element is heatable.

6. The training apparatus in accordance with claim 1, wherein said transmission mechanism is coupled to said foot plates and support element such that said support element is adapted to rotate in a direction toward a foot plate which is moving toward said support element.

7. The training apparatus in accordance with claim 6, wherein said apparatus is adapted such that rotation of a lower half of the user's body in one direction results in a rotation of an upper half of the user's body in an opposite direction.

8. The training apparatus in accordance with claim 1, wherein said support unit is vertically positionably adjustable.

9. The training apparatus in accordance with claim 1, wherein said support unit comprises at least two grips which are adapted to be grasped by the user's hands.

10. The training apparatus in accordance with claim 9, wherein said at least two grips are oriented essentially perpendicular to the axis.

11. The training apparatus in accordance with claim 9, wherein said at least two grips are oriented essentially parallel to the axis.

12. The training apparatus in accordance with claim 9, wherein said at least two grips comprises at least four grips, wherein at least two grips are oriented essentially parallel to the axis, and wherein at least two grips are oriented essentially perpendicular to the axis.

13. The training apparatus in accordance with claim 9, wherein said support unit comprises a support adapted to support at least one of the shoulder, neck, and head of the user.

14. A training apparatus comprising:

a base unit;

foot plates moveably arranged on said base unit for movement in opposite directions and in an essentially same plane, wherein said foot plates are adapted to accommodate the feet of a user;

a support unit adapted to support at least one of upper extremities or a head region of the user, wherein said support unit is rotatable around an axis essentially perpendicular to said same plane; and a transmission mechanism coupled to said foot plates and said support unit so that movement of the foot plates is transformed into rotational movement of said support unit around the axis, wherein said support unit comprises at least two grips which are adapted to be grasped by the user's hands, wherein said support unit comprises a support adapted to support at least one of the shoulder, neck, and head of the user, and wherein said at least two grips and said support are arranged on a common, closed bar linkage.

15. The training apparatus in accordance with claim 1, wherein said support unit comprises a support adapted to support at least one of the shoulder, neck, and head of the user.

16. A training apparatus comprising:

a base unit;

foot plates moveably arranged on said base unit for movement in opposite directions and in an essentially same plane, wherein said foot plates are adapted to accommodate the feet of a user;

a support unit adapted to support at least one of upper extremities or a head region of the user, wherein said support unit is rotatable around an axis essentially perpendicular to said same plane;

a transmission mechanism coupled to said foot plates and said support unit so that movement of the foot plates is transformed into rotational movement of said support unit around the axis; and a rotatable rod having a first and second end, wherein said first end is coupled to said support unit and said second end is coupled to said base unit.

17. The training apparatus in accordance with claim 16, wherein said rod comprises a telescoping rod, whereby a distance between said support element and said base is adjustable.

18. The training apparatus in accordance with claim 16, wherein said transmission mechanism comprises pulleys, and said foot plates are connected to each other with at least a segment of a common belt, and wherein said common belt is guided over at least one of said pulleys, and said rod is coupled to at least one of said at least one pulley and another of said pulleys.

19. A training apparatus comprising:

a base unit;

foot plates moveably arranged on said base unit for movement in opposite directions and in an essentially same plane, wherein said foot plates are adapted to accommodate the feet of a user;

a support unit adapted to support at least one of upper extremities or a head region of the user, wherein said support unit is rotatable around an axis essentially perpendicular to said same plane; and a transmission mechanism coupled to said foot plates and said support unit so that movement of the foot plates is transformed into rotational movement of said support unit around the axis, wherein said base unit comprises rails, wherein said foot plates are coupled to and guided on said rails.

20. The training apparatus in accordance with claim 19, wherein the axis is essentially vertically oriented.

21. A training apparatus comprising:

a base unit having rails;

foot plates moveably arranged on said rails for movement in opposite directions and in an essentially same plane, wherein said foot plates are adapted to accommodate the feet of a user;

a support unit comprising at least two hand grips, said support unit adapted to support at least one of upper extremities or a head region of the user, wherein said support unit is vertically positionably adjustable and rotatable around an axis essentially perpendicular to said same plane;

a transmission mechanism coupled to said foot plates and said support unit so that movement of the foot plates is transformed into rotational movement of said support unit around the axis; and a contact element securely fixed between said base unit and said support unit, wherein said contact element is vertically positionably adjustable to a desired height.

22. The training apparatus in accordance with claim 21, further comprising a telescoping rotatable rod having a first and second end, wherein said first end is coupled to said support unit and said second end is coupled to said base unit, and wherein a distance between said support element and said base is adjustable.

23. The training apparatus in accordance with claim 22, wherein said transmission mechanism is coupled to said foot plates and support element such that said support element is adapted to rotate in a direction toward a foot plate which is moving toward said support element.

24. The training apparatus in accordance with claim 21, wherein said at least two grips are arranged on a common, closed bar linkage.

25. The training apparatus in accordance with claim 21, wherein said transmission mechanism comprises pulleys and gears, said foot plates are connected to a common belt, and said common belt is guided over at least one of the pulleys, and wherein said at least one pulley is coupled to one of said gears for rotatably driving said support element.

26. The training apparatus in accordance with claim 1, wherein said foot plates are arranged for movement parallel to each other.

27. The training apparatus in accordance with claim 1, wherein said foot plates are arranged for moving in inverse directions to each other.

28. The training apparatus in accordance with claim 1, wherein said foot plates are arranged for movement along straight paths.

29. The training apparatus in accordance with claim 1, wherein said foot plates are arranged for moving in directions opposite along the straight paths.

* * * * *